US007273193B2

(12) United States Patent
Slocum et al.

(10) Patent No.: US 7,273,193 B2
(45) Date of Patent: Sep. 25, 2007

(54) PLASTIC BAG DISPENSING UNIT

(75) Inventors: Tracy Lee Slocum, Allison, IA (US); Dominic Trinko, Melbourne, FL (US)

(73) Assignee: Waverly Plastics Company, Inc., Waverly, IA (US)

( * ) Notice: Subject to any disclaimer, the term of this patent is extended or adjusted under 35 U.S.C. 154(b) by 225 days.

(21) Appl. No.: 11/252,091

(22) Filed: Oct. 17, 2005

(65) Prior Publication Data

US 2006/0169829 A1 Aug. 3, 2006

Related U.S. Application Data

(63) Continuation-in-part of application No. 10/357,674, filed on Feb. 4, 2003, now Pat. No. 7,066,422.

(51) Int. Cl.
*B65H 75/28* (2006.01)
*B65H 18/28* (2006.01)

(52) U.S. Cl. ..... 242/593; 242/528

(58) Field of Classification Search ..... 242/160.4, 242/167, 528, 593; 493/178, 194, 196, 197, 493/199, 200, 202, 208, 231, 341, 446, 455, 493/359, 360, 403, 434, 442; 53/118, 119; 206/233, 390, 494

See application file for complete search history.

(56) References Cited

U.S. PATENT DOCUMENTS 1,819,122 A 8/1931 Resnati
4,034,928 A 7/1977 McDonald et al.
4,597,494 A 7/1986 Benoit
4,688,368 A 8/1987 Honegger
4,824,425 A 4/1989 Stock
4,938,608 A 7/1990 Espinosa
5,301,889 A 4/1994 Ball
5,474,208 A 12/1995 Ball
5,582,362 A 12/1996 Johnson et al.
5,609,269 A 3/1997 Behnke et al.
5,619,840 A 4/1997 Nyman et al.
5,776,289 A 7/1998 Steidinger
6,168,558 B1 1/2001 Vinberg
6,186,436 B1 2/2001 Selle et al.
6,964,395 B1 * 11/2005 Lewis et al. ..... 242/593

(Continued)

OTHER PUBLICATIONS

Waverly Plastics promotional material, pp. 15-16, the "Savvy Sak" High Density Liners with coreless roll configuration and interleaved design for "one-at-a-time" dispensing convenience.

(Continued)

*Primary Examiner*—William A. Rivera
(74) *Attorney, Agent, or Firm*—McKee, Voorhees & Sease, P.L.C.

(57) ABSTRACT

A plastic bag roll, dispensing container and service rack combination allows easy docking and positioning of a dispensing carton into a service rack mountable for varied configurations. The dispensing container is specifically crafted to house a roll of plastic bags. A bag is drawn from the center of the role, pulled along the feed pathway and threaded through the dispensing apertures. The electrostatic binding of the individual bags is balanced against the drag generated along the feed pathway and dispensing apertures to insure smooth and accurate disbursement of a single, hygienically safe plastic bag.

20 Claims, 6 Drawing Sheets

U.S. PATENT DOCUMENTS

| | | | | |
|---|---|---|---|---|
| 7,066,422 | B1 * | 6/2006 | Slocum | 242/593 |
| 2002/0030135 | A1 | 3/2002 | Bartels et al. | |
| 2004/0217122 | A1 | 11/2004 | Trinko et al. | |

OTHER PUBLICATIONS

Shelton, Scott, "Effects, Theory and Control of Static Electricity", reprinted from Best's Safety Directory, 1982, by SIMCO, an Illinois Tool Works Company.

McMaster-Carr catalog pp. 1513-1514, Polyethylene Compactor Bags, Tear-Resistant Polyethylene Bags, Polyethylene Draw-Tape Bags, Polyethylene Hazardous Material and Biohazard Bags, Polyethylene Bags are offered in either perforated rolls or folded for dispensing: p. 1515, Recycled Plastic Bags.

Grainter catalog p. 2075 Specialty Trash Can Liners; p. 2076, ROL-OUT® Coreless Roll Liners and Tough Guy® Trash Can Linersp and p. 2077 ROL-OUT® Coreless Roll Liners and Tough Guy® Linear Low Coreless Roll and Flat Pack Can Liners.

Lab Safety Supply catalog pp. 2084-2086 Mobil® Low-Density Can Liners, Heavy-Duty Waste Bags, HDPE Can Liners, Rubbermaid® Coreless Roll Polyliners, Low Density White Can Liners, 6-Mil, Extra-Tough Bags, Mobil® Hefty® Steel Sak® Liners, Clear Can Liners, Poly Drum Liners.

Industrial Material Handling and Industrial Catalog, Big River Equipment Co., Inc. 2002 Fall/Winter Catalog No. 209; Index; 368; p. 229 Poly Bags; p. 234, EconoMizer® Wipers and Scottcloth® Heavy-Duty Wipers with central top dispensing.

Grainger catalog p. 2075 Specialty Trash Can Liners; p. 2076, ROL-OUT® Coreless Roll Liners and Tough Guy® Trash Can Linersp and p. 2077 ROL-OUT® Coreless Roll Liners and Tough Guy® Linear Low Coreless Roll and Flat Pack Can Liners.

* cited by examiner

PLASTIC BAG DISPENSING UNIT

CROSS-REFERENCE TO RELATED APPLICATIONS

This application is a continuation-in-part of U.S. patent application Ser. No. 10/357,674 filed on Feb. 4, 2003, now U.S. Pat. No. 7,066,422 which is a nonprovisional U.S. application, herein incorporated by reference in its entirety.

FIELD OF THE INVENTION

The present invention relates generally to a plastic bag dispenser and more specifically to a plastic bag dispenser using a continuous roll of overlapping plastic bags enclosed in a dispensing carton promoting hygienics and supported by a service rack to insure flawless disbursement of a single bag by preventing jams, feeding malfunctions and multiple feeds.

BACKGROUND OF THE INVENTION

Plastic bags are bulky and must be folded or rolled for packaging and transportation. For example, a typical 24" wide by 24" high plastic bag has a 7 to 10 gallon capacity when filled. Therefore, plastic bags are typically folded to reduce the width in half or a quarter of the original size, folded or rolled, and then stored in a packaging for transportation and dispensing. Plastic bags have, in the past, been stored together or individually.

When plastic bags are stored together they have been typically stored in rolls with perforations defining a point of separation. The purpose of the perforations is so that the continuous roll of bags can be separated, each bag being separable one from another. As such, the bags could be used in a variety of settings and apparatuses providing the user with a way to separate the bags. Continuous rolled bags offer varying means for pulling a bag from the roll. Some allow the user to unwrap a bag from the roll starting with the outward most bag, working inward toward the center of the roll and finishing the roll by taking the inner most bag. Others allow the user to take a bag from the roll starting with the inner most bag, working outward with each subsequent bag, and finishing the roll by taking the outer most bag. It is commonly known that garbage can liners unwrap starting from the outside of the roll and use perforations for separation as a convenience to the user. The perforations allow the user to tear off one bag at a time from the roll. Food storage bags in the grocery store have evolved in the same way. Shoppers are now provided the convenience of rolled food storage bags having perforations optimally positioned so that one bag at a time may be dispensed from the roll. Moreover, special dispensing racks have been developed to insure that a single tug by the shopper, in an effort to separate the bags at the perforations, does not result in multiple bags being dispensed at a time. These racks typically are designed with a retention member that prevents the next bag from dispensing while providing sufficient resistance to ensure that the bag being dispensed separates from the next bag, along the perforations. Yet, even the best attempts to redesign the dispensing rack have not totally prevented multiple bags from spinning off from the roll at the first tug by a user. Even if the next bag is prevented from dispensing, the bags may tear along the body of the bag and not along the perforations, thereby rendering the bag unusable. Thus, the user is then left with the frustrating task of either rolling the bags back up onto the roll and trying again or tearing the bags apart by hand and leaving the others to waste. In addition to creating waste and the user becoming frustrated, malfunctions more often than not result in the user physically handling subsequent bags. More importantly, if the user handles the open end of the bag the bag may no longer be hygienically safe.

Plastic bags that unwrap starting with the exterior bag first and ending with the inner most bag have some of the same problems mentioned above. Furthermore, dispensing the plastic bags starting from the center of the roll may create additional concerns and possible malfunctions. For example, the role could become entirely unusable if the perforations fail before the next bag is pulled from the center of the role. Still, attempts to grab the bag now stuck in the center of the roll could result in increased user frustration and additional waste. In addition, once a user does recover the lost end, the user must pull the two bags apart from each other. Thus, the bags and bag openings are exposed to physical handling and run the risk of becoming contaminated.

Therefore, a primary objective of the present invention is to provide a roll of plastic bags that pulls starting from the center moving outwardly and in which the plastic bags are separated without perforations thus eliminating the potential for malfunctions necessitating the users handling of bags other than the one intended to be removed from the roll.

Plastic bags without perforations have also been stored individually in a folded configuration upon each other. This requires the user to dig within a carton for a bag. In addition, a user may pull out more than one bag rather than just an individual bag.

Therefore, a further objective is to provide a dispensing apparatus that insures that the plastic bags are individually dispensed, one at a time and accessible adjacent the exterior of a dispensing container thereby providing each user a hygienically safe storage bag.

Also previously known in the art is the method of electrostatically charging plastic bags so that they may form a coreless roll. Dispensing starting from the outermost bag and moving inward requires that a user manually handle each bag. In this configuration, the user grasps the outermost bag, tugs, causing the entire roll to spin and this process is performed until the last bag is reached. Because the user must rotate the entire roll to dispense one bag from the roll this configuration is highly susceptible to malfunctions. In particular, if the static binding is less than the rotational resistance of the roll the dispensing bag will prematurely detach from the next bag. Thus, the user has to often handle the bags extensively in search for the lost end of the bag within the container.

Therefore, a further objective is the provision of a roll of plastic bags that may be dispensed without unrolling the roll of plastic bags.

A still further objective of the present invention is the provision of a roll of plastic bags that can be quickly and easily dispensed, one at a time.

A further objective of the present invention is to provide a roll of plastic bags that dispense, one bag at a time, from within a dispensing carton.

A still further objective of the present invention is to provide a hygienically safe plastic bag for each user.

A further objective of the present invention is to provide a dispensing container wherein the roll of plastic bags are stored and dispensed from within the dispensing container, one at a time, to eliminate physical handling of the roll of plastic bags.

Another objective of the present invention is to provide a roll of plastic bags having a dispensing end closely adjacent the dispensing carton for the user to grasp.

A further objective of the present invention is to provide a roll of plastic bags having a dispensing end, for grasping by the user, being the closed end of the plastic bag.

A still further objective of the present invention is to provide a roll of plastic bags wherein the individual bags comprising the roll are not physically attached.

A still further objective of the present invention is to provide a roll of plastic bags wherein the dispensing aperture insures accurate disbursement of one bag at a time and a clean storing environment.

Another objective of the present invention is to provide a roll of plastic bags wherein the feed pathway for the bags prevents multiple feeds.

A further objective of the present invention is to provide a roll of plastic bags electrostatically bound to each other.

A further objective of the present invention is to provide a roll of plastic bags wherein the electrostatic bonds, holding the individual bags together within the dispensing container, are greater than the drag forces along the feed pathway.

Another objective of the present invention is to provide a feed pathway wherein the angles and the dispensing aperture are calculated for the drag forces.

A still further objective of the present invention is to provide a roll of plastic bags wherein the electrostatic bonds, holding the individual bags together without the dispensing container, are less than the drag forces along the feed pathway.

A further objective of the present invention is to provide a roll of plastic bags wherein the dispensing container is the preferred container for shipping.

Another objective of the present invention is to provide a roll of plastic bags wherein the dispensing container is containable by a dispensing rack.

A further of the present invention is to provide a roll of plastic bags, dispensing container and service rack wherein the service rack houses mounting brackets.

A still further objective of the present invention is to provide a service rack wherein the structural elements of the rack are designed to secure the dispensing container against the forces generated by moving the bags from the roll along the feed pathway and out the dispensing aperture.

A still further objective of the present invention is to provide a service rack having front support member lowered to facilitate and accommodate easy loading of the dispensing container.

A further objective of the present invention is to provide a service rack wherein the mounting brackets allow for varied mounting configurations.

A still further objective is a means which permits gripping of the plastic bags when they are not being dispensed.

Another objective of the present invention is the provision of a plastic bag roll dispenser which is economical to produce, durable, and reliable in use.

To accomplish the above and related objects, this invention may be embodied in the form illustrated in the accompanying drawings; however, the drawings are illustrative only, and changes may be made in the specific constructions illustrated which are preferred embodiments only.

SUMMARY OF THE INVENTION

In its broadest sense, the invention comprises a plastic bag roll, dispensing container and service rack combination. The combination provides a service rack mountable to accommodate a variety of disbursement configurations. The service rack houses adaptable mounting brackets and has a clean look and design. The service rack is configured with a lowered front retaining member that allows a dispensing carton to be easily docked and positioned. The dispensing container is specifically crafted to house a roll of plastic bags. A bag is drawn from the center of the role, pulled along the feed pathway and threaded through the dispensing apertures. The electrostatic binding of the individual bags is balanced against the drag generated along the feed pathway and dispensing apertures to insure smooth and accurate disbursement of a single plastic bag. The dispensing container insures that each bag is kept hygienically safe for the next user. The invention is specifically designed to prevent multiple feeds, waste and user frustration by allowing a user to extract a single, clean plastic bag from a dispensing container. The invention also relates to specific constructional features embodying this concept in a manner that is both economical and will aid in waster elimination. Such constructional details are described in the preferred embodiment set forth below.

DETAILED DESCRIPTION OF A PREFERRED EMBODIMENT

Figure 1:
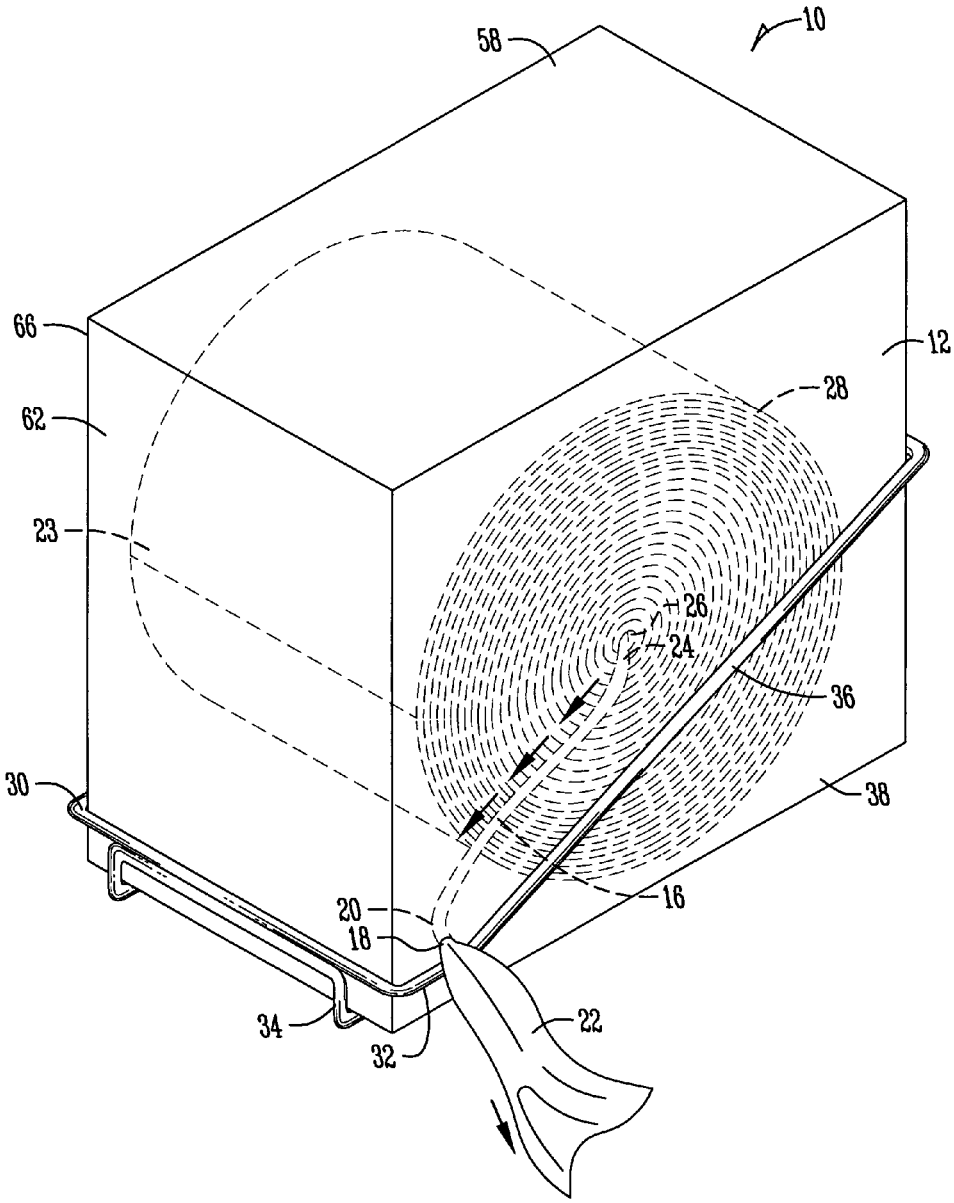
FIG. 1 is a perspective view of the plastic bag dispensing unit.

Turning now to the drawings in which similar reference characters denote similar elements through the several views, illustrated in FIGS. 1-7 is the combination of various views and in-use configurations of the plastic bag dispensing unit. The plastic bag dispensing unit being described with particularity herein.

The plastic bag dispensing unit is referred to generally as 10. As seen in FIG. 1, the plastic bag dispensing unit has a axial center dispensing plastic bag roll 28 housed in a dispensing carton 12 being docked in a dispensing rack 14.

The rolled plastic bags 28 have a dispensing end 22 and a non-dispensing end 23. The dispensing end 22 and non-dispensing end 23 form the opposite ends of the rolled plastic bags 28. The dispensing end 22 is pulled from the axial center 26 bent along the axial center angle 24, follows the feed pathway 16, bends along the dispensing aperture angle 20 and exits the dispensing carton 12 through the lid dispensing aperture 18. The dispensing end 22 is positioned for grasping just outside the carton lid 38 and lid dispensing aperture 18.

The dispenser carton 12 is a rectangular box as seen in FIG. 1. Alternatively, other box shapes known in the art may be used to contain the rolled plastic bags 28.

Figure 6:
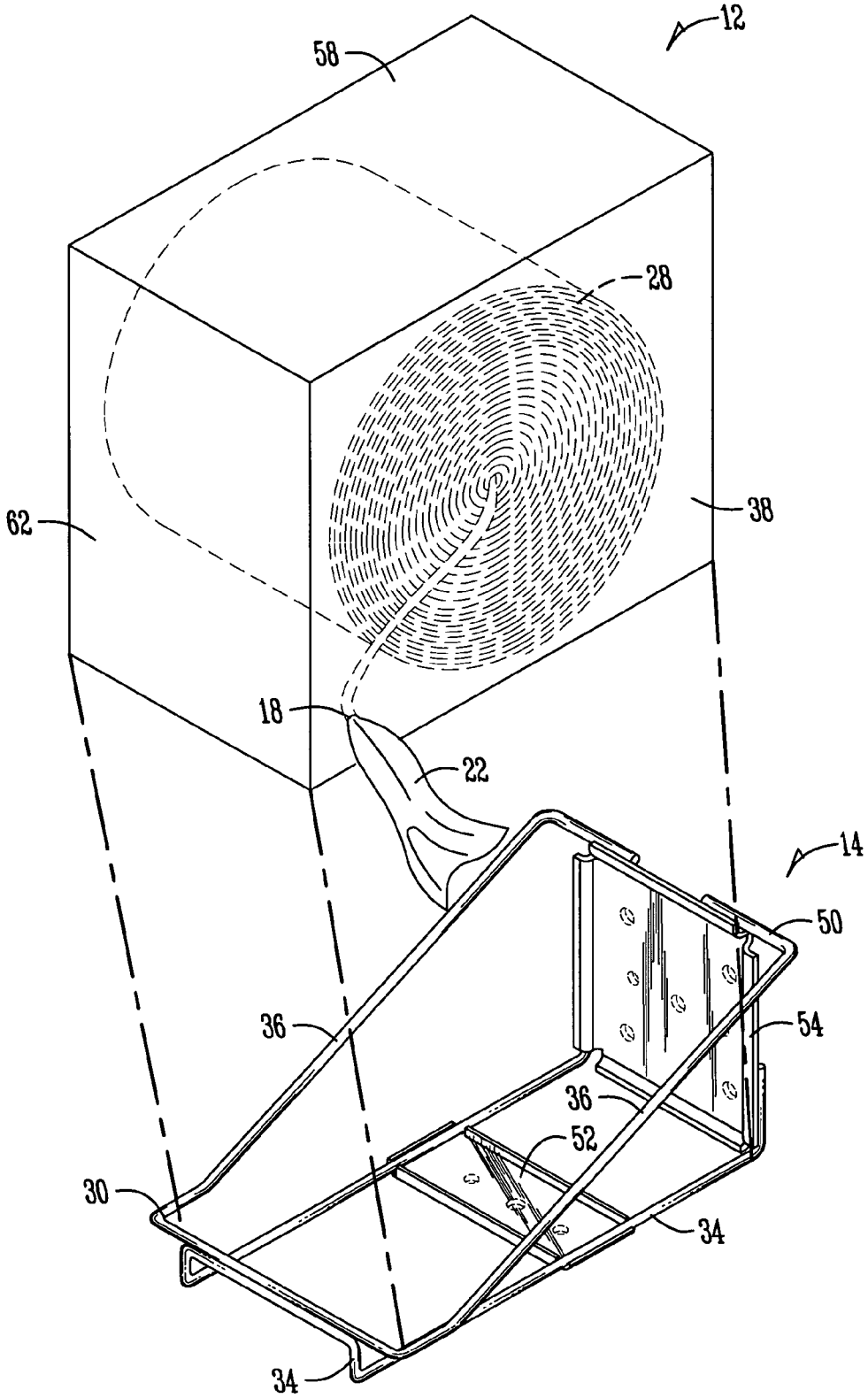
FIG. 6 is a perspective view of the dispensing carton being positioned for docking in the service rack; the service rack housing mounting brackets.

The dispensing carton 12 is docked in a dispensing rack 14 as best illustrated in FIG. 6. The dispensing rack 14 has a bottom retaining member 34 connected to the front retaining member 30. The bottom retaining member 34 houses the bottom mounting brace 52 and is connected to the rear mounting brace 54. The rear mounting brace 54 is connected to the rear retaining member 50. The rear retaining member 50 and front retaining member 30 are connected to the side retaining member 36. Both the rear and bottom mounting braces 54, 52 are adapted to accommodate varied mounting arrangements. The braces 54, 52 also serve as stiffening members to the dispensing rack 14. The dispensing rack 14 is designed so that the deepest portion of the dispensing rack is located nearest the rear retaining member 50. The dispensing rack 14 is the shallowest near the front retaining member 30. The side retaining member 36 runs from the shallow front retaining member 30, rising to the height of the rear mounting brace 54 and forming the deepest portion of the dispensing rack 14 at the rear retaining member 50. Both the rear and bottom mounting braces 52, 54 have mounting holes 64 for securing the dispensing rack 14 in a mounting position.

Figure 2:
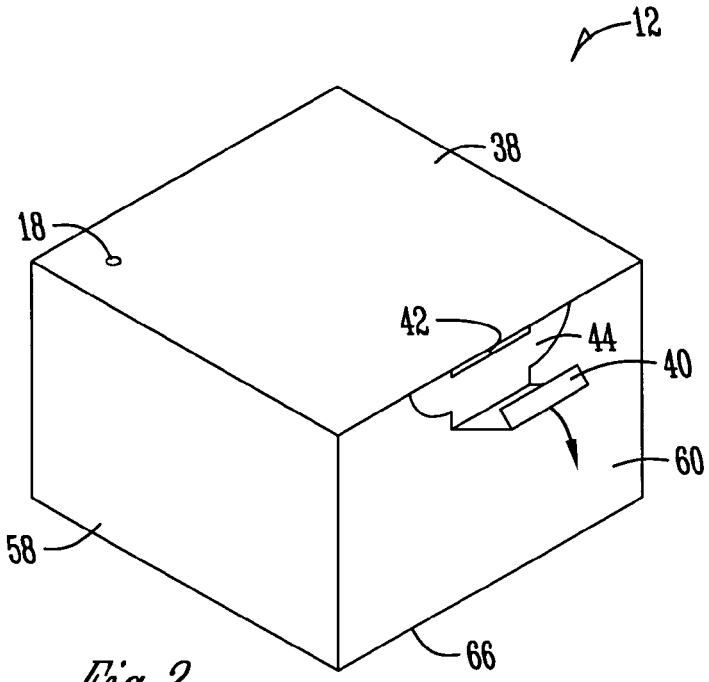
FIG. 2 is a perspective view of the dispensing carton and aperture.
Figure 3:
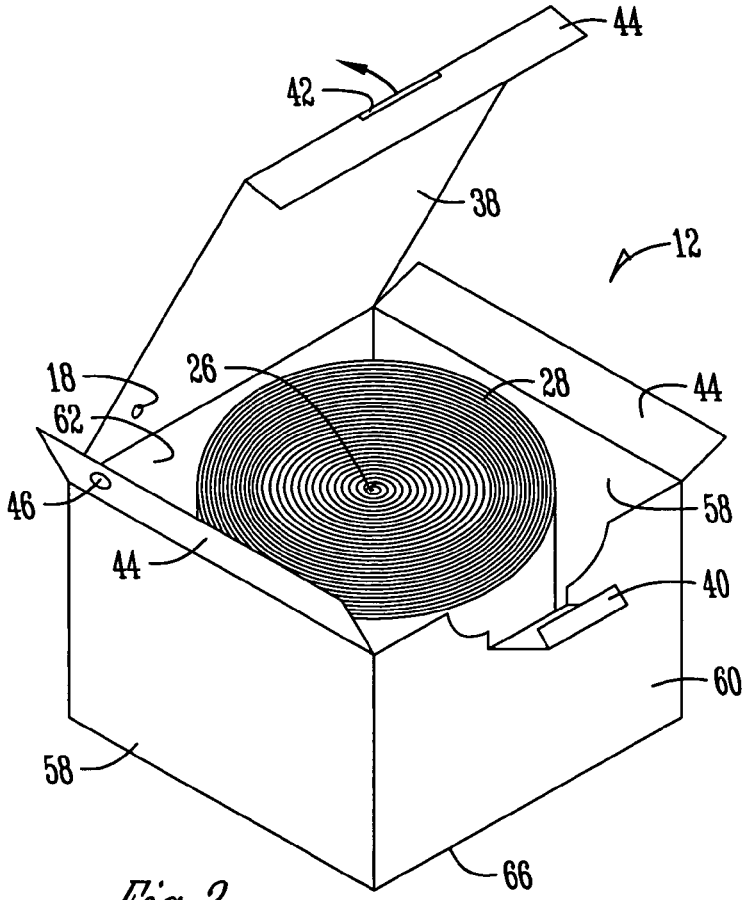
FIG. 3 is a perspective view of the open lidded dispensing carton and aperture; the carton housing the roll of plastic bags.
Figure 4:
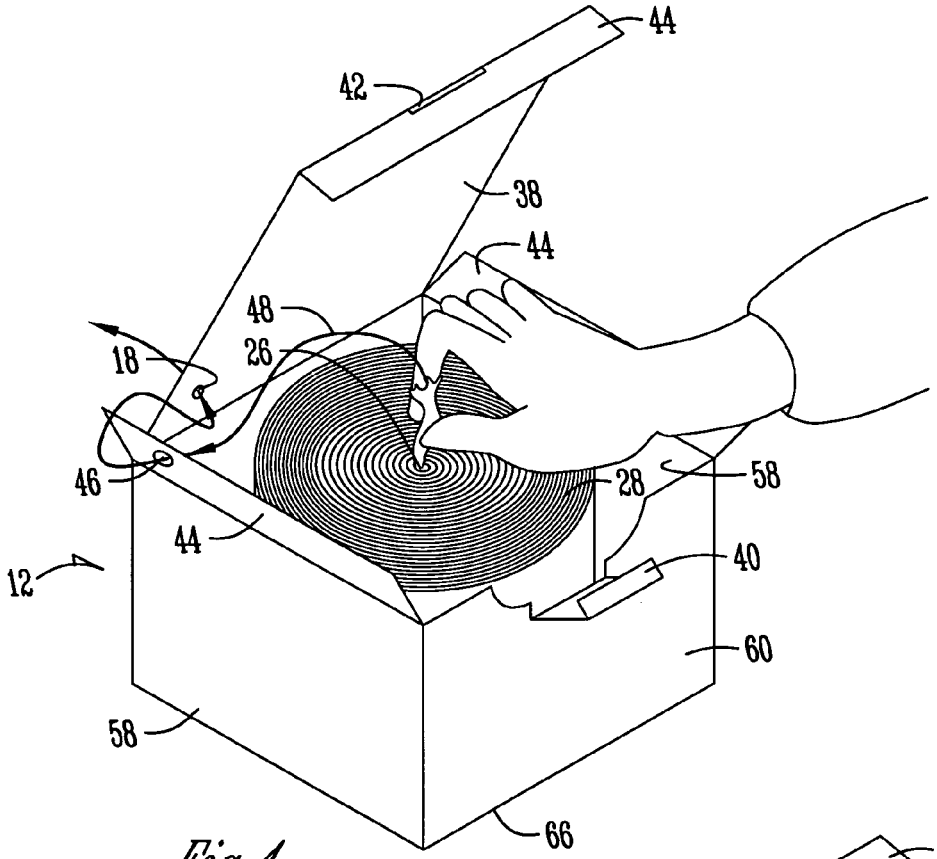
FIG. 4 is a perspective view of the open lidded dispensing carton and aperture; the carton housing the roll of plastic bags.

The dispensing carton 12 has a dispensing aperture 18 in the carton lid 38, as illustrated in FIG. 2. The dispensing aperture 18 is positioned on the carton lid 38 near the carton side wall 58 and rear wall 62. The dispensing carton 12 is formed having a pair of side walls 58 connected to a front wall 60, a rear wall 62 and a bottom 66 with a lid 38 being attached to the rear wall 62. The lid is fitted with a flap 44 having an opening 42 for receiving the retention flap 40 mounted to the front wall 60 of the dispensing carton 12. The lid is secured and removed by inserting or removing the retention flap 40 in the opening 42 on the flap 44. The side walls 58 are fitted with flaps 44, also. Flaps 44 add structural integrity to the dispensing carton 12 when the lid 38 is closed. The flap 44 has a flap dispensing aperture 46. The dispensing carton 12 is designed to house the rolled plastic bags 28, provide a means of hygienical protection and structurally support the dispensing process. The volume of the dispensing carton 12 is designed to fit the rolled plastic bags 28.

Figure 5:
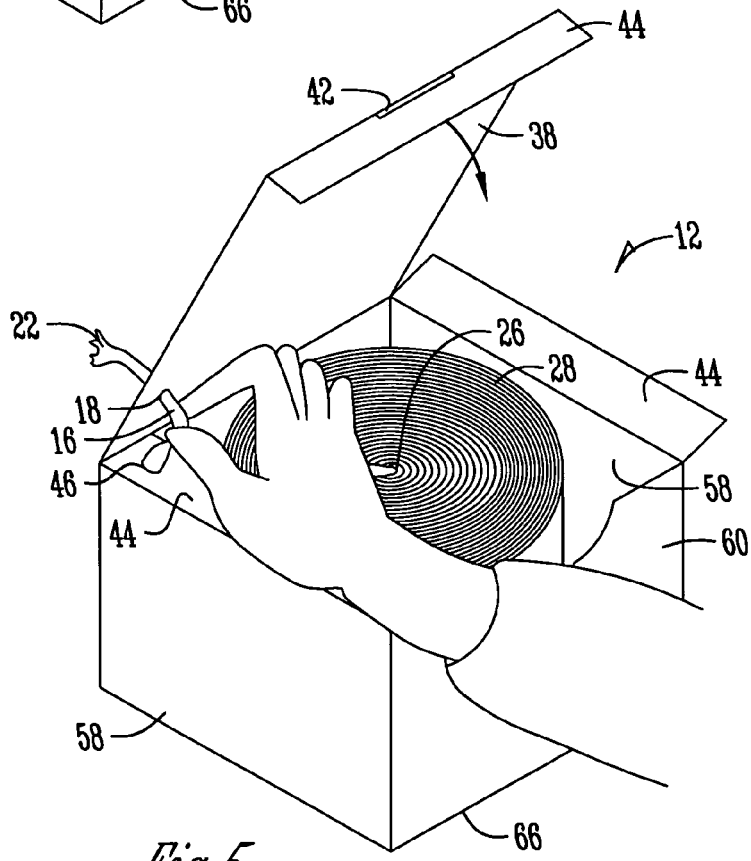
FIG. 5 is a perspective view of the open lidded dispensing carton and aperture; the carton housing the roll of plastic bags being fed through the dispensing apertures.

In use, the plastic bag dispenser 10 has rolled plastic bags 28 pre-positioned inside the dispensing carton 12. The dispensing end 22 is located at the axial center 26 of the roll of plastic bags 28, illustrated by FIG. 4. The dispensing end 22 is pulled from the axial center 26 and threaded through the flap dispensing aperture 46 and then through the lid dispensing aperture 18. Once the dispensing end 22 is positioned outside the dispensing carton 12, as best illustrated by FIG. 5, the flanges 44 are folded and the lid 38 is closed securing the flange 44 inside of the front wall 60 of the dispensing carton 12. The retention flap 40 is removably secured to within the opening positioned between the flange 44 and the lid 38. In FIG. 5 the dispensing end 22 is held closely adjacent the lid 38 and the lid dispensing aperture 18, while the lid 38 is closed in the direction indicated by the illustrated arrow.

FIG. 1. illustrates best the feed pathway 16. The feed pathway 16 is a preferred design. The rolled plastic bags 28 are disbursed from the axial center 26 and bend along the axial center angle 24 forming a 90-degree angle. The feed pathway 16 for the rolled plastic bags 28 than runs closely adjacent the interior side of the carton lid 38 and the roll of plastic bags 28. The feed pathway 16 exits the carton lid 38 through both the lid dispensing aperture 18 and the flap dispensing aperture 46, but not before bending through another 90-degree angle, the dispensing aperture angle 20. The apertures 18, 46 need not necessarily be the same size. Both the lid dispensing aperture 18 and the flap dispensing aperture 46 are sized to permit a single plastic bag from the roll of plastic bags 28 to be completely withdrawn from within the dispensing carton 12, leaving each subsequent plastic bag having a dispensing end 22 located closely adjacent the carton lid 38. Both the lid dispensing aperture 18 and the flap dispensing aperture 46 are sized to prevent a plastic bag from being drawn back into the dispensing carton 12 once the dispensing end 22 has been withdrawn to a desired position outside of the dispensing carton 12.

As seen in FIG. 6, the dispensing rack 14 is sized and shaped so as to allow for the dispensing carton 12 to be docked within the dispensing rack 14. The dispensing rack 14 is designed such that, no matter the mounting location of the rack, the dispensing carton 12 is easily docked into the dispensing rack 14. In particular, the user need only lift the dispensing carton 12 over the front retaining member 30 to dock the dispensing carton 12 in the dispensing rack 14. The convenience of this configuration is particularly relevant in situations where the dispensing rack is mounted at a height above the height of the user's shoulders. Thus, the lowered front retaining member 30 eases the strain experienced by the user when docking the dispensing carton 12 in the dispensing rack 14. The dispensing rack 14 is configured to support the dispensing carton 12 while extracting a plastic bag 56. The side retaining member 36 sits closely adjacent the lid dispensing aperture 18 and acts as a structural stiffening element to the carton lid 38 and the lid dispensing aperture 18. Thus, as the dispensing bag 22 is drawn out of the dispensing carton 12 in an outward or downward motion, the side retaining member 36 prevents the flap and lid dispensing apertures 18, 46 from tearing under the force.

Figure 7:
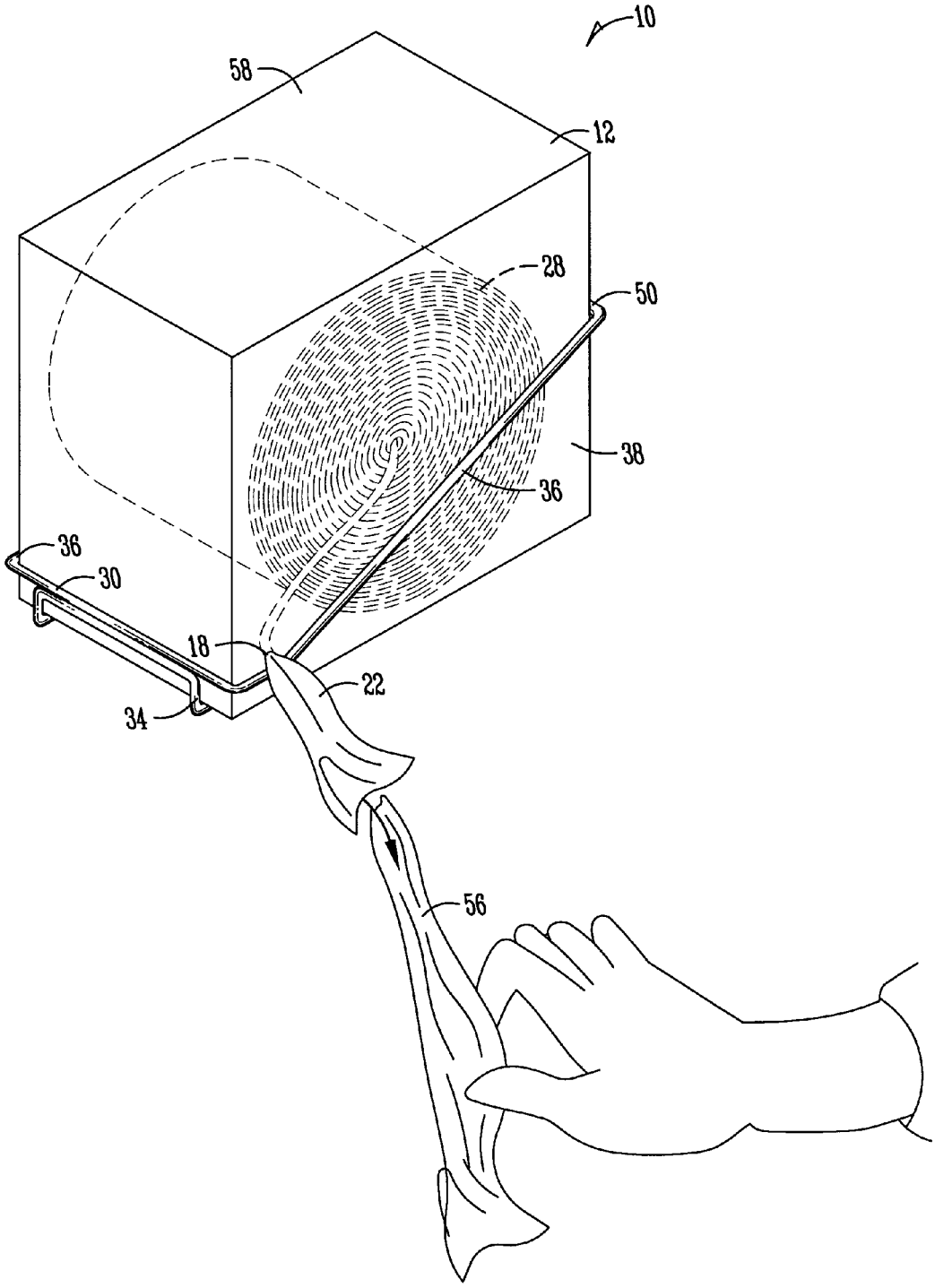
FIG. 7 is a perspective view of a single plastic bag being physically extracted through the dispensing aperture of the dispensing container for use.
Figure 9:
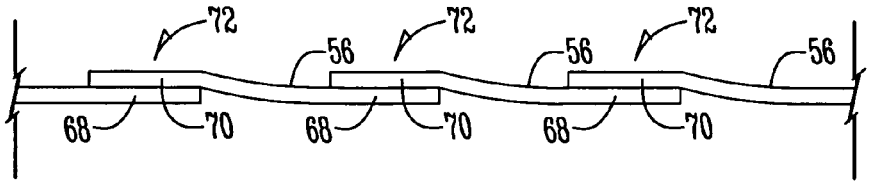
FIG. 9 is a side view of FIG. 8 showing the overlap between the plastic bags.

In FIG. 7, the plastic bag dispensing unit 10 is used to dispense a hygienically clean plastic bag 56. In FIG. 1, the roll of plastic bags 28 is a coreless roll of multiple, discrete, consecutive, plastic bags 28 which overlap each other in the circumferential direction of the roll such that the opposite edges of the sheets in sum total define the opposite ends 22, 23 of the roll 28. As illustrated in FIG. 9 the plastic bags 56 have a first end 68 and a second end 70. The plastic bags 56 have an overlap area 72. The overlap area 72 is defined as a point of overlap between the first end 68 and the second end 70. The first end 68 and the second end 70 overlap each other in the circumferential direction of the roll 28.

Figure 8:
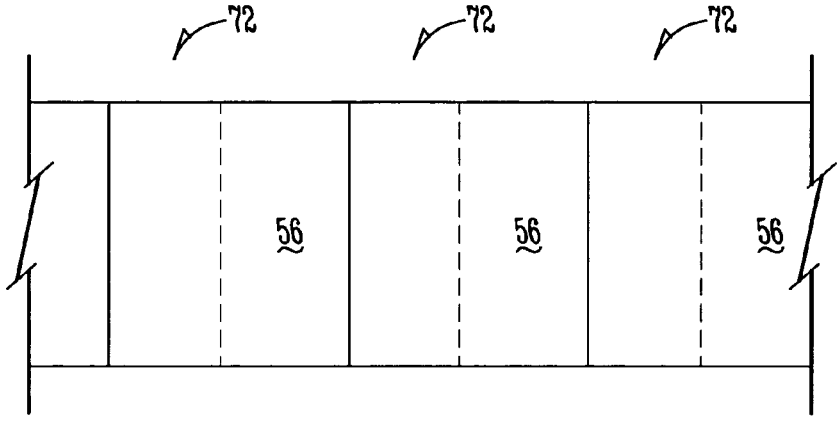
FIG. 8 is a fragmentary top plan view of a series of plastic sheets bags showing the bags aligned with overlap between the plastic bags.

The plastic bags 56 are held to one another at the overlap area 72. The overlap area 72 may vary in width; however, preferably, the overlap area is regular in width. The plastic bags 56 are held together by an electrostatic bond. As shown in FIGS. 8 & 9, the discrete, consecutive plastic bags 56 are placed such that they overlap each other. The overlap of these bags 56 is preferably within the range of 4" to 6".

There may also be an electrostatic charge upon the area of the plastic bag 56 that is not part of the overlap area 72. This electrostatic charge aids in maintaining the integrity of the roll shape.

Initially, the plastic bags 56 are not statically charged. Without a static charge, the plastic bags 56 will not cling to one another. Without this connection, the plastic bags 56 will slip off one another and not serve the function of being able to be pulled from the axial center of a the roll of plastic bags 28. An electrostatic charge may be placed upon the plastic bags 56 through a static pinner or by some other means for applying a static charge. The applied static charge is a controlled charge application. Alternatively, an electrostatic charge may be placed upon the plastic bags 56 through processing of the plastic bags 56.

The plastic bags 56 used for this process may be made of high-density polyethylene (HDPE). The plastic bags 56 may also be low linear density polyethylene (LLDPE). Alternative plastics well known in the art may be used. Plastic is an insulator. Within an insulator the flow of electrons is limited; because of this, an insulator may retain several static charges of different potentials and polarities at various areas on its surface. Connecting the insulator to ground will not release the electrostatic charge.

Specifically, the plastic bags 56 anticipated to be used for this product are plastic bags. The specific plastic bags may be seen in Table 1 below. Table 1 encompasses a variety of plastic bags and sizes, roll count, roll diameter, roll height, and thickness. The table refers to Waverly Plastic Item numbers divided by high density polyethylene (HDPE) and low linear density polyethylene (LLDPE). This creates a potential difference between the plastic bags 56 and the grounding surface. It is this electrostatic charge that is the bonding action. The duration of the bonding action between the plastic bags 56 depends upon such factors as humidity, insulative quality of the materials and subsequent processes.

TABLE 1

| Item No. | Size Width | Size Height | New Roll Count | Roll Dia. | Case Wt. | Roll Ht. | GAL. CAP. | COLOR | Mic./Mil |
|---|---|---|---|---|---|---|---|---|---|
| HDPE | | | | | | | | | |
| T242406N | 24 | 24 | 250 | 3.9" | 2.35 | 6 | 7-10 | CLEAR | 6 mic. |
| T243106N | 24 | 31 | 250 | 435" | 3.03 | 6 | 8-10 | CLEAR | 6 mic. |
| T304410N | 30 | 44 | 125 | 4.7" | 4.37 | 7.5 | 20 | CLEAR | 10 mic. |
| T334614N | 33 | 46 | 100 | 5" | 5.67 | 8.25 | 32 | CLEAR | 14 mic. |
| T375214N | 37 | 52 | 75 | 4.7" | 5.39 | 9.25 | 44 | CLEAR | 14 mic. |
| T375217N | 37 | 52 | 75 | 5.15" | 6.57 | 9.25 | 44 | CLEAR | 17 mic. |
| T434816N | 43 | 48 | 75 | 4.8" | 6.63 | 10.75 | GLT | CLEAR | 16 mic. |
| T445714N | 44 | 57 | 75 | 4.9" | 7.03 | 11 | 56 | CLEAR | 14 mic. |
| T445717N | 44 | 57 | 50 | 4.4" | 5.71 | 11 | 56 | CLEAR | 17 mic. |
| T445722N | 44 | 57 | 50 | 5" | 7.42 | 11 | 56 | CLEAR | 22 mic. |
| LLDPE | | | | | | | | | |
| TL242305K | 24 | 23 | 200 | 4.8" | 3.68 | 6 | 7-10 | BLACK | .5 mil. |
| TL243005K | 24 | 30 | 150 | 4.8" | 3.6 | 6 | 8-10 | BLACK | .5 mil. |
| TL304308K | 30 | 43 | 75 | 5.1" | 5.16 | 7.5 | 20 | BLACK | .8 mil. |
| TL334510K | 33 | 45 | 50 | 4.8" | 4.95 | 8.25 | 32 | BLACK | 1.0 mil. |
| TL334514K | 33 | 45 | 25 | 4" | 3.46 | 8.25 | 32 | BLACK | 1.4 mil. |
| TL375010K | 37 | 50 | 50 | 5" | 6.16 | 9.25 | 44 | BLACK | 1.0 mil. |
| TL375014K | 37 | 50 | 25 | 4.2" | 4.31 | 9.25 | 44 | BLACK | 1.4 mil. |
| TL434714K | 43 | 47 | 25 | 4.1" | 4.71 | 10.75 | GLT | BLACK | 1.4 mil. |
| TL445510K | 44 | 55 | 25 | 3.7" | 4.03 | 11 | 56 | BLACK | 1.0 mil. |
| TL445517K | 44 | 55 | 25 | 4.9" | 6.86 | 11 | 56 | BLACK | 1.7 mil. |

With the products in the above mentioned table, the plastic bags 56 are folded twice to create a cross section having four sheet bags 56 also describable as eight plastic sheet bags 56.

As seen in FIG. 1, the plastic bags 56 may be wound to encircle axial center 26 multiple times. Alternatively, the plastic bags 56 may be wound to encircle axial center 26 once. Still alternatively, the plastic bags 56 may partially circle the axial center 26.

In operation, the statically charged plastic roll of bags 28 come to the consumer within a dispensing carton 12. The user pulls the first plastic bag 56 from the axial center 26 of the roll of plastic bags 28. The user than draws the first plastic bag 56 along a feed pathway 16. The feed pathway 16 is defined by the first plastic bag 56 passing through a 90-degree angle 24 along the feed pathway 16 and through another 90-degree angle 20. The first plastic bag 56 exits the interior of the dispensing carton 12 to form a dispensing end 22 on the exterior of the dispensing carton 12, by passing through both the apertures in the flange 46 and the carton lid 18. Drawing the first plastic bag 56 from the axial center 26, through the feed pathway 16 and out the apertures 18, 46 creates a chain of plastic bags 56, being drawn from the axial center 26 of the roll of plastic bags 28 to the exterior of the dispensing carton 12 for grasping by the user. FIG. 7 shows the user pulling on the dispensing end 22; the electrostatic binding between the first plastic bag 56 and the dispensing end 22 is less than the drag and electrostatic forces on the plastic bags within the dispensing container 12, thus the first plastic bag 56 separates from the dispensing end 22. This process is continued allowing the user to draw a single hygienically safe first plastic bag 56 from the dispensing carton 12. The plastic bag dispenser 10 allows for single first plastic bag 56 disbursements every time by balancing the electrostatic forces binding the overlap between the first end 68 and the second end 70 against the drag forces experienced by the roll of plastic bags 28 traveling along the feed pathway 16 and through the dispensing apertures 16, 4. The plastic bag dispenser 10 allows the user to grasp the first plastic bag 56 and separate it from the dispensing end 22 without handling the dispensing end of each subsequent bag. The dispensing apertures 16, 46 are sized and shaped to insure that the first plastic bag 56 releases in substantially the same shape as plastic bags forming the roll 28. Both the flange aperture 46 and the lid aperture 18 are substantially circular. It is contemplated that the shape and size of the apertures 18, 46 may be altered to assist in providing a smooth disbursement of the first plastic bag 56 from the dispensing carton 12. The present configuration contemplates the roll of plastic bags being circumferentially arranged to facilitate the open or closed end of the plastic bag 56 being the dispensing end 22.

In the drawings and specifications there has been set forth a preferred embodiment of the invention, and although specific terms are employed, these are used in a generic descriptive sense only and not for purposes of limitation. Changes in the form and the proportion of parts as well as in the substitution of equivalents are contemplated as circumstance may suggest or render expedient without departing from the spirit or scope of the invention in the following claims.

What is claimed is:

1. A bag dispensing system for dispensing in a hygienically clean manner, the system comprising:

a plurality of plastic bags arranged to form a roll by electrostatically binding the bags, the roll of bags having an axial center, the roll of bags being arranged by overlapping opposite ends of adjacent bags within the roll and electrostatically charging the overlapping ends;

a carton for storing the plurality of bags, the carton having a dispensing aperture;

a feed path for dispensing bags, the feed path between the axial center of the roll and the dispensing aperture in the carton such that electrostatic forces binding a bag to be dispensed and a next bag to each other are balanced against drag forces associated with the feed path such that the bag to be dispensed is separated from the roll without need for handling the next bag in the roll and thereby in the hygienically clean manner.

2. The bag dispensing system of claim 1 wherein the feed path includes a first substantially 90 degree angle and a second substantially 90 degree angle.

3. The bag dispensing system of claim 2 wherein the dispensing aperture in the carton is positioned and shaped to assist in generating a drag force balanced against the electrostatic forces binding the bags together as the bag to be dispensed transits along the feed path.

4. The bag dispensing system of claim 3 wherein the feed path is configured such that the drag forces exceed the electrostatic force binding the overlapping ends of the bag to be dispensed and the next bag at the point when the overlapping ends substantially exit the dispensing aperture.

5. The bag dispensing system of claim 4 wherein the bags within the roll of bags are folded such that as overlapping ends of the bag to be dispensed and the next bag pass through the dispensing aperture, the bag to be dispensed begins to expand and unfold thereby decreasing the electrostatic binding forces between the bag to be dispensed and the next bag to assist in separating the bag to be dispensed from the next bag.

6. The bag dispensing system of claim 5 wherein the dispensing carton has a lid and a set of flanges for interlocking, the lid and flanges thereby assisting to provide structural integrity of the carton, the dispensing aperture being fitted in the lid and the flange to prevent the apertures from tearing.

7. The bag dispensing system of claim 6 wherein the aperture in the flange has a diameter and the aperture in the lid has a diameter, the diameter of the aperture in the flange being greater than the diameter of the aperture in the lid.

8. The bag dispensing system of claim 7 further comprising a rack adapted for holding the carton.

9. The bag dispensing system of claim 8 wherein the rack comprises a front, a bottom a side and a rear retaining member, the retaining members being configured and connected to define a rack for holding the carton, the rack further comprises a front, a bottom and a back, the back and the bottom housing a mounting bracket, the mounting brackets providing structural integrity to the rack, the front retaining member forming a shallow lip for easily docking and retaining the carton in the rack.

10. The bag dispensing system of claim 9 wherein the side retaining member is positioned closely adjacent the dispensing aperture for supporting the structural integrity of the dispensing aperture.

11. The bag dispensing system of claim 1 wherein the bags are arranged within the roll such that an open end of each bag is dispensed before a closed end of each bag.

12. The bag dispensing system of claim 1 wherein the electrostatic forces binding the overlapping ends of the bag to be dispensed and the next bag are applied by calculation and balanced against the drag forces.

13. A system for dispensing a bag, comprising:

a plurality of plastic bags arranged to form a roll by electrostatically binding the bags, the roll of bags having an axial center and wherein each of the plastic bags within the roll has an overlapping end, the roll of bags being arranged by overlapping ends of adjacent bags within the roll and electrostatically charging the overlapping ends, the roll of bags being folded;

a carton for storing the plurality of bags, the carton having a lid and a dispensing aperture wherein the aperture has a size, the size being calculated for drag;

a feed path for dispensing bags, the feed path between the axial center of the roll and the dispensing aperture in the carton such that electrostatic forces binding a bag to be dispensed and a next bag to each other are balanced against drag forces generated by the feed path such that the bag to be dispensed is separated from the roll without need for handling the next bag in the roll and thereby in the hygienically clean manner; and a dispensing end of the plastic bag calculated to unfold after passing through the dispensing aperture such that the unfolding of the plastic bag decreases the electrostatic binding forces between the bag to be dispensed and the next bag to assist in separating the bag to be dispensed from the next bag.

14. The system of dispensing a bag of claim 13 wherein the feed path is arranged to provide for feeding the plastic bags out of the dispensing aperture by first pulling the plastic bags through a first substantially 90 degree angle closely adjacent the axial center and a second substantially 90 degree angle closely adjacent the dispensing aperture.

15. The system of dispensing a bag of claim 13 further comprising a rack adapted for holding the carton.

16. The system of dispensing a bag of claim 13 wherein the rack comprises a side retaining member optimally positioned to abut a periphery of the dispensing aperture wherein the member is a structural support member for the dispensing aperture during extraction of the plastic bag.

17. The system of dispensing a bag of claim 13 wherein a front retaining member forming a shallow lip allows the dispensing carton to be easily docked and positioned within the rack.

18. The system of dispensing a bag of claim 13 wherein a position and a shape of the aperture in the carton are calculated to generate a drag force, the drag forces exceeding the electrostatic force binding the overlapping ends of the bag to be dispensed and the next bag at the point when the overlapping ends substantially exit the dispensing aperture.

19. The system of dispensing a bag of claim 13 wherein the feed path includes pulling the plastic bags from the axial center, pulling the plastic bags between and closely adjacent an interior surface of the carton lid and a surface defining the roll of bags, the plastic bags being drawn without the dispensing carton through the dispensing aperture.

20. A bag dispensing system for dispensing in a hygienically clean manner, the system comprising:

a plurality of plastic bags arranged to form a roll by electrostatically binding the bags, the roll of bags having an axial center and wherein each of the plastic bags within the roll are arranged by overlapping ends of adjacent bags within the roll and electrostatically charging the overlapping ends;

a carton for storing the plurality of bags, the carton having a dispensing aperture;

a feed path for dispensing bags, the feed path between the axial center of the roll and the dispensing aperture in the carton such that electrostatic forces binding a bag to be dispensed and a next bag to each other are balanced against drag forces generated by the feed path such that the bag to be dispensed is separated from the roll without need for handling the next bag in the roll and thereby in the hygienically clean manner;

wherein the feed path includes a first substantially 90 degree angle and a second substantially 90 degree angle between the axial center of the roll and the dispensing aperture.

* * * * *